United States Patent [19]

Kihara et al.

[11] Patent Number: 5,043,712

[45] Date of Patent: Aug. 27, 1991

[54] CHARACTER DISPLAY APPARATUS

[75] Inventors: Yoshiro Kihara, Nara; Jyunko Yamao, Osaka, both of Japan

[73] Assignee: Sharp Kabushiki Kaisha, Osaka, Japan

[21] Appl. No.: 308,005

[22] Filed: Feb. 9, 1989

[30] Foreign Application Priority Data

Feb. 9, 1988 [JP] Japan ..... 63-15983[U]

[51] Int. Cl.[5] ..... G09G 1/14

[52] U.S. Cl. ..... 340/735; 340/750; 434/157; 400/109

[58] Field of Search ..... 400/109, 110, 111, 484; 340/750, 751, 735; 434/157, 159, 167, 169; 364/419; 341/28

[56] References Cited

U.S. PATENT DOCUMENTS 4,500,872 2/1985 Huang ..... 400/110
4,604,698 8/1986 Ikemoto et al. ..... 364/419
4,636,977 1/1987 Ikemoto et al. ..... 364/419
4,698,758 10/1987 Larsen ..... 400/110

*Primary Examiner*—Alvin E. Oberley
*Assistant Examiner*—Wu Xiao Min

[57] ABSTRACT

A Chinese character display apparatus includes a font memory for storing character fonts and tone symbol fonts. There is a first memory for storing strings of pairs of a character code and a tone code arranged in order of the character arrangement in a sentence that is to be displayed. A code selection device reads out the character codes and tone codes from the first memory in order of the character arrangement and distinguishes the character codes from the tone codes. There is a second memory having a first memory area for storing the character fonts respectively indicated by the character codes, in order of the character arrangement, and a second memory area for storing the tone symbol fonts respectively indicated by the tone codes.

5 Claims, 5 Drawing Sheets

| TONE | | TONE CODE | SYM-BOL |
|---|---|---|---|
| FOUR-TONE | FIRST TONE | $10_H$ | — |
| | SECOND TONE | $11_H$ | ／ |
| | THIRD TONE | $12_H$ | ∨ |
| | FOURTH TONE | $13_H$ | ＼ |
| NEUTRAL-TONE | | $14_H$ | ○ |

| ∨ | ／ | ＼ | — | ＼ | ／ | ○ |
|---|---|---|---|---|---|---|
| 请 | 您 | 再 | 说 | 一 | 回 | 吧 |

CHARACTER DISPLAY APPARATUS

BACKGROUND OF THE INVENTION

1. Field of the Invention

This invention relates to a character display apparatus. More particularly, it relates to a Chinese language display apparatus.

2. Description of the Prior Art

When Chinese words that make up a sentence are spoken, they are intonated in accordance with the meaning of the sentence. A sentence acquires a different meaning depending upon the manner of intonation of the Chinese characters in that sentence. In the tone system of Chinese, tones are classified into the so-called four-tone and neutral-tone, and each character consisting a sentence is provided with one of the tones. The four-tone and neutral-tone are indicated by symbols as described below.

Each of the four-tones are represented by. The first-tone is to intonate flatly and is represented by the symbol "—". The second-tone corresponds to the rising tone and is represented by the symbol "/". The third-tone corresponds to the rising and falling tone and is represented by the symbol "V". The fourth-tone corresponds to the falling tone and is represented by the symbol "\". The neutral-tone is to pronounce lightly the corresponding word and is represented by the symbol "○". The relations between the tones and the symbols are summarized in FIG. 3.

When a Chinese sentence corresponding to an English sentence, e.g., "Please say it once more." is to be displayed on a display of an electronic translator, it would be very preferable for a learner if a tone symbol is also displayed in the vicinity of each of the characters consisting the sentence, as shown in FIG. 7.

In such a translator, in order to display a tone symbol in the vicinity of a corresponding character, it is necessary to know the positional relation between the character and the tone symbol in advance of displaying them. The measure described below can with this requirement. Namely, a memory region is allocated to character data, and another memory region is allocated to tone symbol data and positional information for correlating tone symbols with characters. Since the positional information for correlating tone symbols with characters must be memorized, this measure has various drawbacks that the amount of data to be stored is increased, that a memory means of a larger capacity is required, and that the control of the display is difficult.

SUMMARY OF THE INVENTION

The character display apparatus of this invention, which overcomes the above-discussed and numerous other disadvantages and deficiencies of the prior art, comprises a font memory means for storing character fonts and tone symbol fonts. The improvement includes a first memory means for storing one or more strings of pairs of a character code and a tone code, said character code corresponding to a Chinese character in a sentence to be displayed and corresponding to one of said character fonts, said tone code indicating a tone symbol corresponding to the tone of the accompanying character which is to be produced in the sentence. The pairs are arranged in order of the character arrangement in the sentence; a code selection means reads out said character codes and tone codes from said first memory means in order of the character arrangement and distinguishes said character codes from said tone codes. There also is a second memory means having a first memory area for storing the character fonts respectively indicated by said character codes, in order of the character arrangement, and a second memory area for storing the tone symbol fonts respectively indicated by said tone codes.

In a preferred embodiment, the apparatus is a translator.

In a first preferred embodiment, the apparatus is a translator from a language other than Chinese into Chinese. In another preferred embodiment, the character codes are of two-byte codes and said tone codes are of one-byte codes. In further preferred embodiment, the tone codes are selected so as not to be identical with any of the upper digits of said character codes.

Thus, the invention described herein makes possible the objectives of:

(1) Providing a character display apparatus which can display characters and tone symbols without memorizing positional information for correlating the tone symbols with the characters;

(2) Providing a character display apparatus in which the capacity of a memory means can be reduced; and (3) Providing a character display apparatus in which the control of displaying characters and tone symbols can be easily performed.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 2:
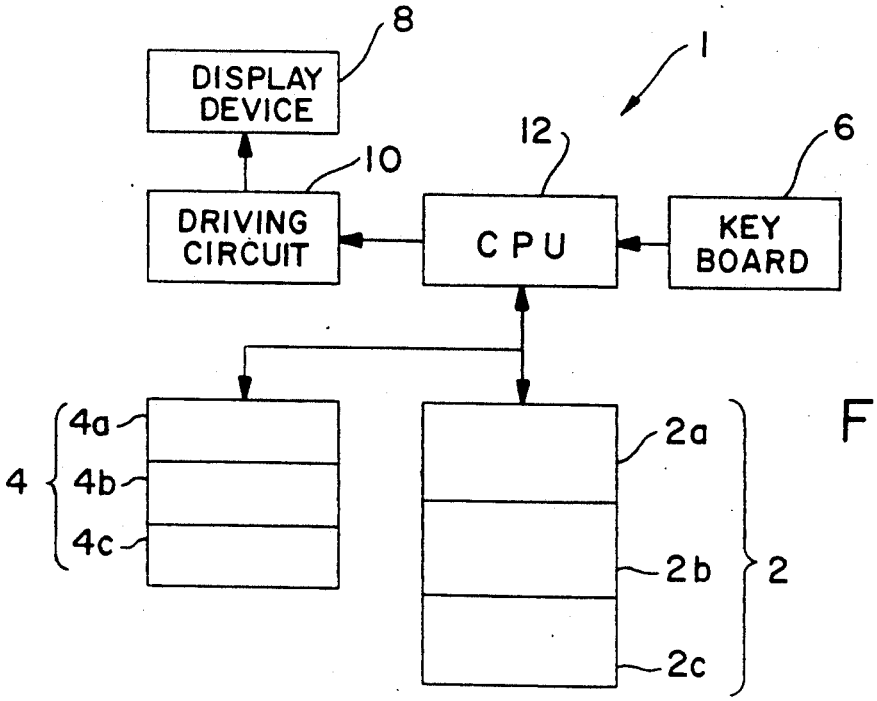
FIG. 2 is a block diagram of a character display apparatus of the invention.
Figures 3, 5, 7:
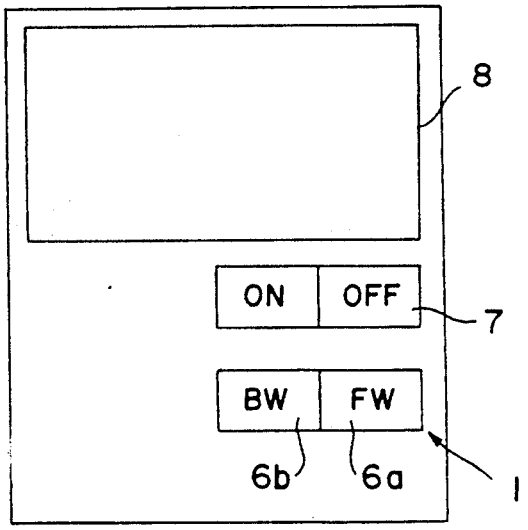
FIG. 3 shows a table illustrating the relation between the tones and the tone symbols.
FIG. 5 is a plan view of the character display apparatus of FIG. 2.
FIG. 7 shows a Chinese sentence corresponding to "Please say it once more." in which a tone symbol is indicated in the vicinity of each character.

FIG. 2 shows a block diagram of a character display apparatus according to the invention. The character display apparatus 1 of FIG. 2 is used as a display means of a portable translator for translating a sentence from English into Chinese or vice versa. The apparatus 1 comprises a ROM 2, a RAM 4, a key board 6, a liquid crystal display device 8, a driving circuit 10 for the display device 8, and a CPU 12 for controlling the operation of the apparatus. FIG. 5 shows a plan view of the apparatus 1. In the key board 1, an on/off switch 7, a forward search key 6*a* and a backward search key 6*b* are disposed as shown in FIG. 5. The driving circuit 10 incorporates a display RAM (not shown) which temporarily stores character fonts and tone symbol fonts.

In this embodiment, a two-byte code is assigned to each Chinese character in the same manner as in JIS X 0208-83. Hereinafter, such a two-byte code representing a Chinese character is referred to as "a character code". As shown in FIG. 3, a one-byte code is assigned to each tone symbol. Hereinafter, such a one-byte code representing a tone symbol is referred to as "a tone code". In the first two bytes of all of the character codes, codes (e.g., $10_H$–$14_H$) which are assigned to the tone codes are not used.

Figures 4A, 4B:
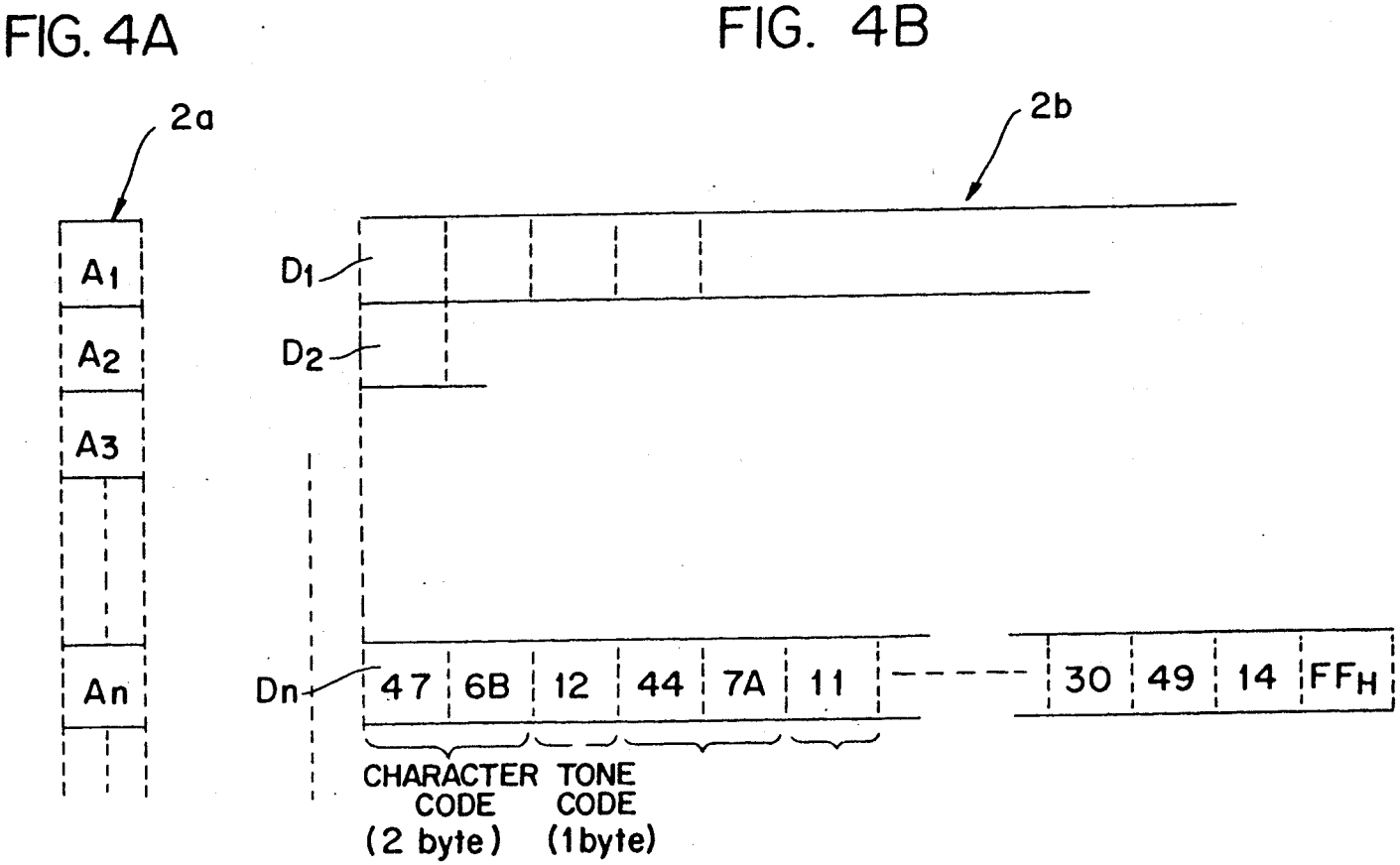
FIG. 4A illustrates diagrammatically the contents of the first memory region of the ROM.
FIG. 4B illustrates diagrammatically the contents of the second memory region of the ROM.

The ROM 2 comprises first to third memory regions 2*a* to 2*c*. FIGS. 4A and 4B illustrate diagrammatically the contents of the first and second memory regions 2*a* and 2*b*, respectively. In the second memory region 2*b*, code groups $D_1, D_2, \ldots, D_n, \ldots$ are stored. Each of the code groups $D_1, \ldots, D_n, \ldots$ represents a Chinese sentence corresponding to a English sentence such as "Please say it once more.", "Good morning." or the like. If the code group $D_n$ represents the sentence of FIG. 7 which means "Please say it once more.", pairs of one character code (e.g., $476B_H$) and one tone code (e.g., $12_H$) are arranged in series to represent Chinese characters and tone symbols shown in FIG. 7. An end code ($FF_H$) representing the end of the sentence is disposed at the end of each code group. In a code group, character codes are arranged in order of the character arrangement in the sentence which the code group represents, and each tone code is positioned behind the corresponding character code.

In the first memory region 2*a*, stored are addresses $A_1, A_2, \ldots, A_n, \ldots$ each of which is an index of the corresponding one of the code groups $D_1, \ldots, D_n, \ldots$. The third memory region 2*c* stores Chinese character fonts corresponding to the character codes, and tone symbol fonts corresponding to the tone codes. By operating the forward search key 6*a* or the backward search key 6*b*, one of the addresses $A_1, \ldots, A_n, \ldots$ stored in the first memory region 2*a* of the ROM 2 is sequentially selected.

Figure 8:
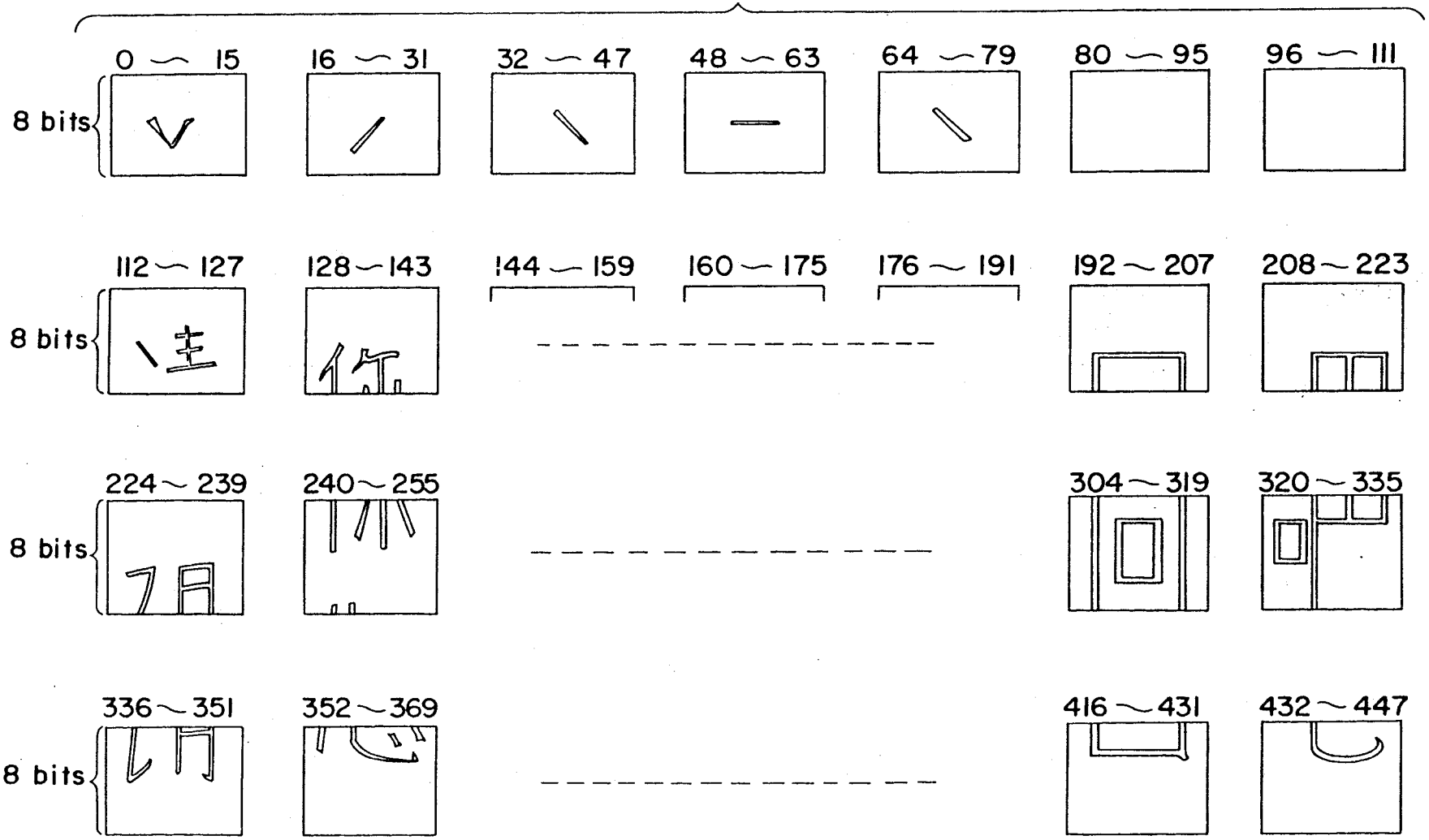
FIG. 8 is a diagram illustrating the arrangement of character fonts and tone symbol fonts in the RAM.

The RAM 4 comprises first to third memory regions 4*a* to 4*c*. The selected address is temporarily stored in the first memory region 4*a*. The CPU 12 reads out from the second memory region 2*b* of the ROM 2 a code group the address of which has been stored in the first memory region 4*a*, and send the read out code group to the second memory region 4*b* of the RAM 4. Character fonts and tone symbol fonts represented by the character codes and tone codes consisting the code group which has been stored in the second memory region 4*b* are read out from the third memory region 2*c* of the ROM 2 to be stored in the third memory region 4*c*. In the third memory region 4*c*, as shown in FIG. 8, the character fonts and tone symbol fonts are arranged in order of the character arrangement of the sentence to be displayed. More specifically, as illustrated in FIG. 8, tone symbol fonts are stored in address Nos. 0–111, and character fonts are stored in address Nos. 112–447.

Figure 6:
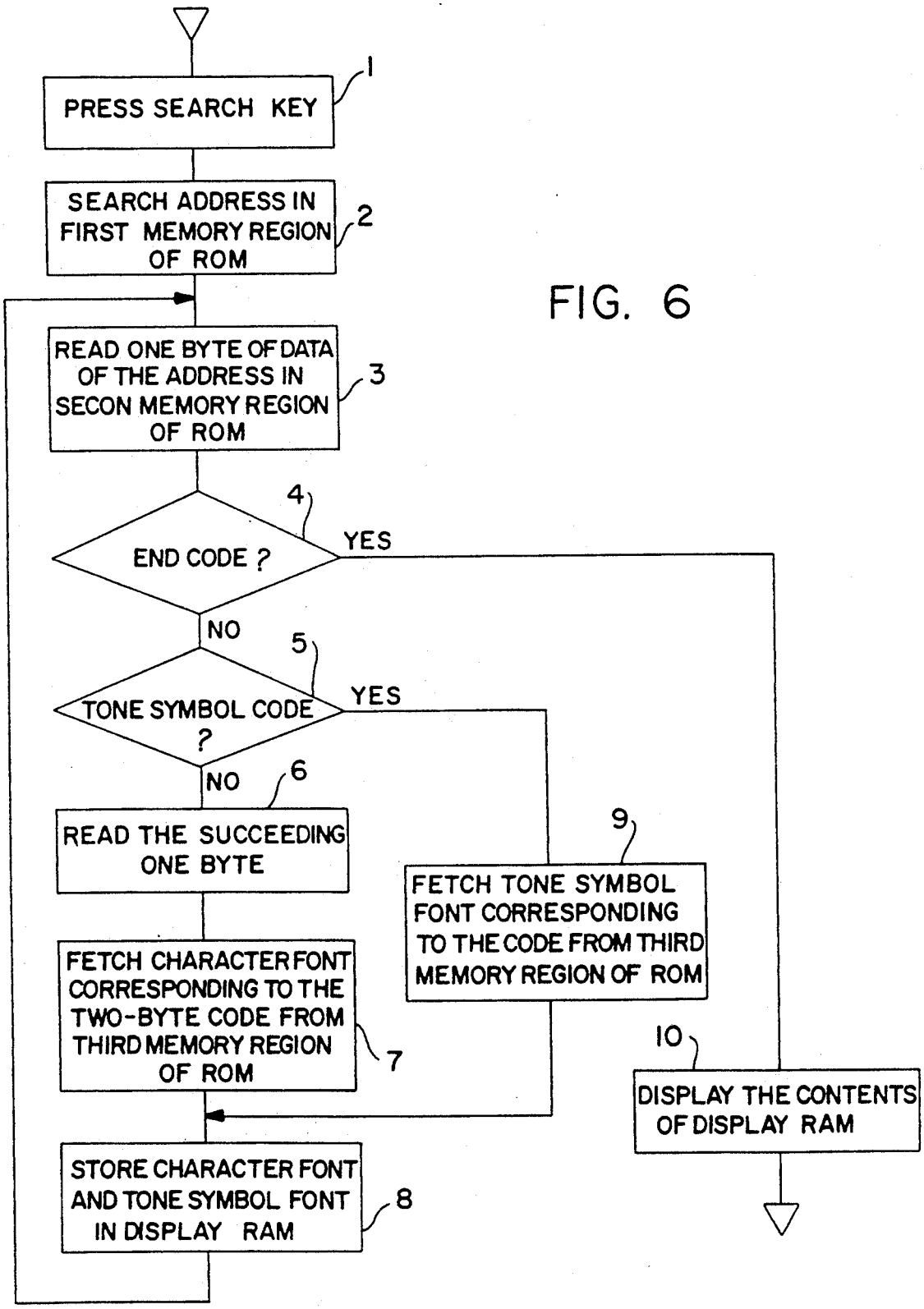
FIG. 6 is a flow chart illustrating the operation of the character display apparatus of FIG. 2.

The operation of the character display apparatus of this embodiment will be be described in more detail with reference to a flow chart shown in FIG. 6. First, the forward search key 6*a* is pressed n times (step 1). According to the number of operation of the key 6*a* or 6*b*, the CPU 12 searches one of the read-out initiating addresses (in this case, the address $A_n$) stored in the first memory region 2*a* of the ROM 2 (step 2) which is then stored in the first memory region 4*a* of the RAM 4. Thereafter, the CPU 12 searches the code group $D_n$ corresponding to the address $A_n$, and reads the first one byte (in this case, $47_H$) of the code group $D_n$ (step 3).

The CPU 12 judges whether or not the data in the first byte is the end code ($FF_H$) (step 4). If the data is not judged as the end code, the CPU 12 then judges whether the data is a tone code or not (step 5). As described above, a tone code is selected so as not to be identical with the code in the first byte of any character codes.

Figure 1:
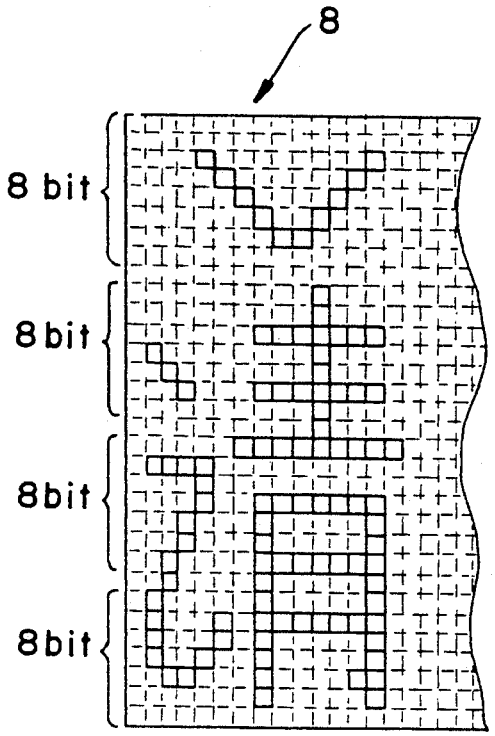
FIG. 1 is a view diagrammatically illustrating the arrangement of the character font and tone symbol font of one Chinese character in a displayed sentence.

In response to the detection of the end code ($FF_H$) in step 4, the CPU 12 controls the driving circuit 10 so that the character fonts and tone symbol fonts stored in the display RAM are sent to the liquid crystal display device 8 (step 10). The display device 8 displays the characters and tone symbols corresponding to the character codes and tone codes in the code group $D_n$. Namely, a Chinese sentence which means "Please say it once more." is displayed in which each tone symbol is positioned above the corresponding Chinese character. FIG. 1 illustrates in more detail the arrangement of the character font and tone symbol font of the first Chinese character in the displayed sentence.

When the code of the first byte is not judged as a tone code, the process proceeds to step 6 wherein the CPU 12 reads the code (in this case, $6B_H$) of the second byte succeeding the first byte, and stores the codes of the first and second bytes as a two-byte character code (in this case, $476B_H$) in the second memory region 4*b* of the RAM 4. The character font corresponding to the two-byte character code ($476B_H$) stored in the memory region 4*b* is fetched from the third memory region 2*c* of the ROM 2 (step 7), and is stored in the address Nos. 112–127, 224–239 and 336–351 of the third memory region 4*c* of the RAM 4 as shown in FIG. 8. The first address (i.e., 112) is temporarily stored in a working area of the RAM. The character font of the character code ($476B_H$) is transferred to the display RAM in the driving circuit 10 to be stored therein in the same manner as in the memory region 4*c* (step 8). Then, the process returns to step 3.

When the code of the first byte is judged as a tone code in step 5, the code (in this case, $12_H$) is stored in the second memory region 4*b* of the RAM 4. The tone symbol font corresponding to the tone code ($12_H$) stored in the memory region 4*b* is fetched from the third memory region 2*c* of the ROM 2, and is stored in the third memory region 4*c* (step 9). The first address number (0) of the addresses numbers (0–15) wherein the tone symbol font is stored has been obtained by subtracting 112 which has been stored from the first address (112) for the character font. The tone symbol font of the tone code ($12_H$) in the memory region 4*c* is transferred to the display RAM in the driving circuit 10 to be stored therein in the same manner as in the memory region 4*c* (step 8). Then, the process returns to step 3. The steps 3 to 9 are repeated until when the end code ($FF_H$) is detected, so that the character fonts and tone symbol fonts of all of character codes and tone codes in the code group $D_n$ are stored in the memory region 4*c* and also in the display RAM. In this way, the apparatus of the invention can display characters and their associating tone symbols without positional information correlating therebetween.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. In a character display apparatus comprising a font memory means for storing character fonts and tone symbol fonts, the improvement comprising first memory means for storing one or more strings of pairs of a character code and a tone code, said character code corresponding to a Chinese character in a sentence to be displayed and corresponding to one of said character fonts, said tone code indicating a tone symbol corresponding to the tone of the accompanying character which is to be produced in the sentence, said pairs being arranged in order of the character arrangement in the sentence;

code selection means which reads out said character codes and tone codes from said first memory means in order of the character arrangement and distinguishes said character codes from said tone codes;

second memory means having a first memory area for storing the character fonts respectively indicated by said character codes, in order of the character arrangement, and a second memory area for storing the tone symbol fonts respectively indicated by said tone; and display means for displaying said stored character fonts and said stored tone symbol fonts, said character fonts being displayed in order of said character arrangement of said sentence, said tone symbol fonts being respectively displayed in the vicinity of said displayed character fonts.

2. An apparatus according to claim 1, wherein said apparatus is a translator.

3. An apparatus according to claim 1, wherein said apparatus is a translator from a language other than Chinese into Chinese.

4. An apparatus according to claim 1, wherein said character codes are of two-byte codes and said tone codes are of one-byte codes.

5. An apparatus according to claim 4, wherein said tone codes are selected so as not to be identical with any of the upper digits of said character codes.

* * * * *